US005788388A

United States Patent [19]

Cowger et al.

[11] Patent Number: 5,788,388

[45] Date of Patent: Aug. 4, 1998

[54] INK JET CARTRIDGE WITH INK LEVEL DETECTION

[75] Inventors: Bruce Cowger, Corvallis; Eric Gasvoda, Salem, both of Oreg.

[73] Assignee: Hewlett-Packard Company, Palo Alto, Calif.

[21] Appl. No.: 785,121

[22] Filed: Jan. 21, 1997

[51] Int. Cl.[6] ..... B41J 2/01

[52] U.S. Cl. ..... 400/703; 347/7; 347/19

[58] Field of Search ..... 347/7, 6, 84, 85, 347/86, 87, 19; 346/140.1; 400/703

[56] References Cited

U.S. PATENT DOCUMENTS

| | | | |
|---|---|---|---|
| 4,568,954 | 2/1986 | Rosback . | |
| 4,977,413 | 12/1990 | Yamanaka et al. | 347/7 |
| 5,049,898 | 9/1991 | Arthur et al. | 400/703 |
| 5,132,711 | 7/1992 | Shinada et al. | 347/7 |
| 5,155,502 | 10/1992 | Kimura et al. . | |
| 5,162,817 | 11/1992 | Tajika et al. | 347/7 |
| 5,172,140 | 12/1992 | Hirabayashi et al. | 347/23 |
| 5,250,957 | 10/1993 | Onozato | 347/7 |
| 5,315,317 | 5/1994 | Terasawa et al. | 347/7 |
| 5,367,328 | 11/1994 | Erickson | 347/7 |
| 5,414,452 | 5/1995 | Accatino et al. . | |
| 5,479,193 | 12/1995 | Shimoda et al. | 347/7 |
| 5,488,395 | 1/1996 | Takayanagi et al. | 347/7 |
| 5,506,611 | 4/1996 | Ujita et al. | 347/19 |
| 5,610,635 | 3/1997 | Murray | 347/7 |
| 5,623,290 | 4/1997 | Iida et al. | 347/7 |
| 5,629,727 | 5/1997 | Erickson | 347/7 |
| 5,631,674 | 5/1997 | Shinada et al. | 347/7 |
| 5,635,961 | 6/1997 | Sato | 347/7 |
| 5,652,610 | 7/1997 | Kawai et al. | 347/7 |
| 5,657,057 | 8/1997 | Nakajima et al. | 347/7 |

FOREIGN PATENT DOCUMENTS

0720916A2 10/1996 European Pat. Off. .

*Primary Examiner*—Eugene H. Eickholt

[57] ABSTRACT

A replaceable ink cartridge for an ink jet printing system having an ink supply station with an ink receptacle and a printer electrical connector. The cartridge has a housing removably matable with the ink supply station. An electrical circuit and a connected cartridge electrical connector reside on the housing, and the cartridge electrical connector is matable with the printer electrical connector. An ink reservoir in the housing defines a chamber containing a supply of ink of a selected volume, and has an ink outlet connectable to the printer ink receptacle. An ink level sensor in the housing is connected to the cartridge electrical connector, and detects whether the supply of ink is less than a threshold amount. If so, it generates an "ink depleted" signal.

26 Claims, 3 Drawing Sheets

INK JET CARTRIDGE WITH INK LEVEL DETECTION

FIELD OF THE INVENTION

This invention relates to ink jet cartridges, and more particularly to two-part ink jet cartridges with separate ink supplies.

BACKGROUND AND SUMMARY OF THE INVENTION

A typical ink jet printer has a pen that reciprocates over a printable surface such as a sheet of paper. The pen includes a print head having an array of numerous orifices through which droplets of ink may be expelled into the surface to generate a desired pattern. Some ink jet printers have a replaceable ink supply mounted to a stationary position on the printer, and connected to a reciprocating print head by a conduit. This permits the use of a larger ink supply, and avoids the need to replace the print head each time the supply of ink is depleted. Color ink jet printers generally have a multi-chamber cartridge, or several ink supply cartridges each containing a different color of ink.

Some existing systems provide each stationary ink supply cartridge with an on board electronics memory chip to communicate information about the contents of the cartridge. It may also be possible for such a chip to serve as a "gas gauge" that indicates or transmits to the printer the amount of ink remaining, so that the user may observe and anticipate the need for replacing a depleted cartridge.

The on board memory in an ink cartridge may also serve to record or store other information about the ink cartridge, such as manufacture date (to ensure that excessively old ink does not damage the print head,) ink color (to prevent misinstallation,) and product identifying codes (to ensure that incompatible or inferior source ink does not enter and damage other printer parts.)

However, for very low cost applications, these advantages provided by a memory chip in each disposable cartridge may be outweighed by the cost of replacing the chip every time a cartridge is depleted. In addition, there may be other elements in a cartridge, such as structural, plumbing, and pumping components, that have useful lives that extend well beyond the time it takes to deplete the ink supply. With separate chips and ink supply elements, one may replace or refill the ink supply portion of an existing cartridge. However, the chip in the cartridge normally sends an "ink depleted" signal to the printer that inhibits printer operation. Even if a chip were provided to send a signal to enable printer operation after the first supply is depleted, such an approach would defeat the printer's protections against "dry firing."

Dry firing occurs when an ink jet printer continues its printing functions after an ink supply is depleted. This causes user inconvenience, supply waste, and possible printer component damage. In one scenario, a user may be printing a job having many pages of high quality color output. If a single ink color becomes depleted early in the job without the user being aware, subsequent sheets will be unusable, wasting valuable media and the inks of the other colors.

In addition, the print head itself, a valuable component not routinely replaced in such a printer, may be damaged by dry firing, requiring professional printer service. Thermal ink jet print heads have an ink chamber associated with each orifice, with a resistor in each chamber vaporizing a quantity of ink to provide the expansion that expels a droplet of liquid ink onto the media sheet. Normally, the continuous flow of ink during printing maintains a controlled temperature of the resistor, preventing ink from drying or being "cooked" onto the resistor surfaces. However, when the ink supply is interrupted, ink remaining in each chamber may have its volatile or aqueous carrier boiled away by the resistor heating, and the remaining solids may encrust the resistor surface or block the orifice. Thus, even if the ink supply is replenished, some orifices may remain clogged, and the heat transfer characteristics of some resistors may be unacceptably altered.

Thus there exists a need for a low cost ink jet printing system that prevents dry firing while permitting retaining non-depleted elements of an ink cartridge while replenishing or replacing an ink supply, for a printer that has sensors to avoid using a depleted cartridge.

The present invention overcomes or reduces the disadvantages of the prior art by providing a replaceable ink cartridge for an ink jet printing system having an ink supply station with an ink receptacle and a printer electrical connector. The cartridge has a housing removably matable with the ink supply station. An electrical circuit and a connected cartridge electrical connector reside on the housing, and the cartridge electrical connector is matable with the printer electrical connector. An ink reservoir in the housing defines a chamber containing a supply of ink of a selected volume, and has an ink outlet connectable to the printer ink receptacle. An ink level sensor in the housing is connected to the cartridge electrical connector, and detects whether the supply of ink is less than a threshold amount. If so, it generates an "ink depleted" signal.

DETAILED DESCRIPTION OF A PREFERRED EMBODIMENT

Figure 1:
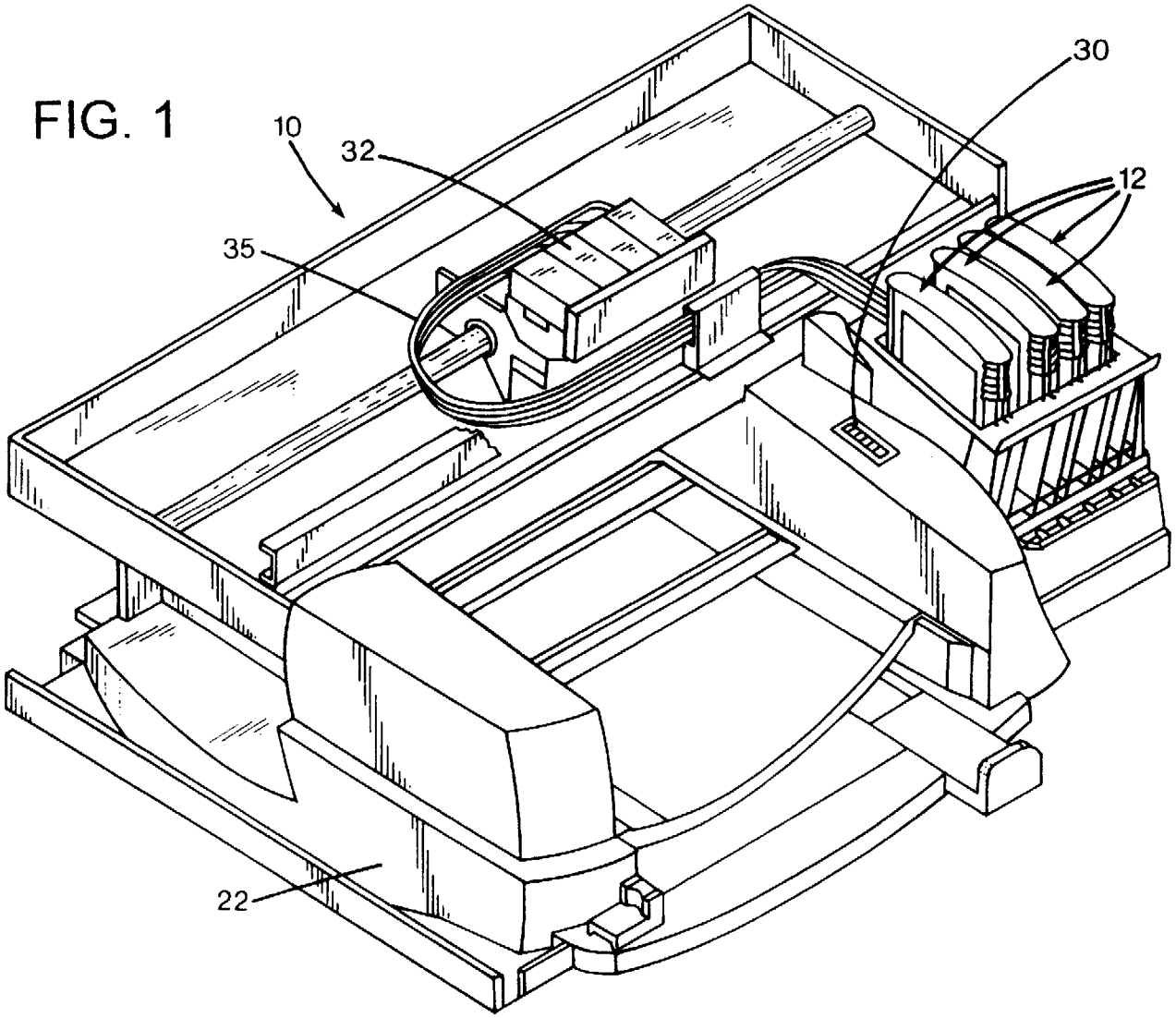
FIG. 1 is a perspective view of a printer according to a preferred embodiment of the invention.
Figure 2:
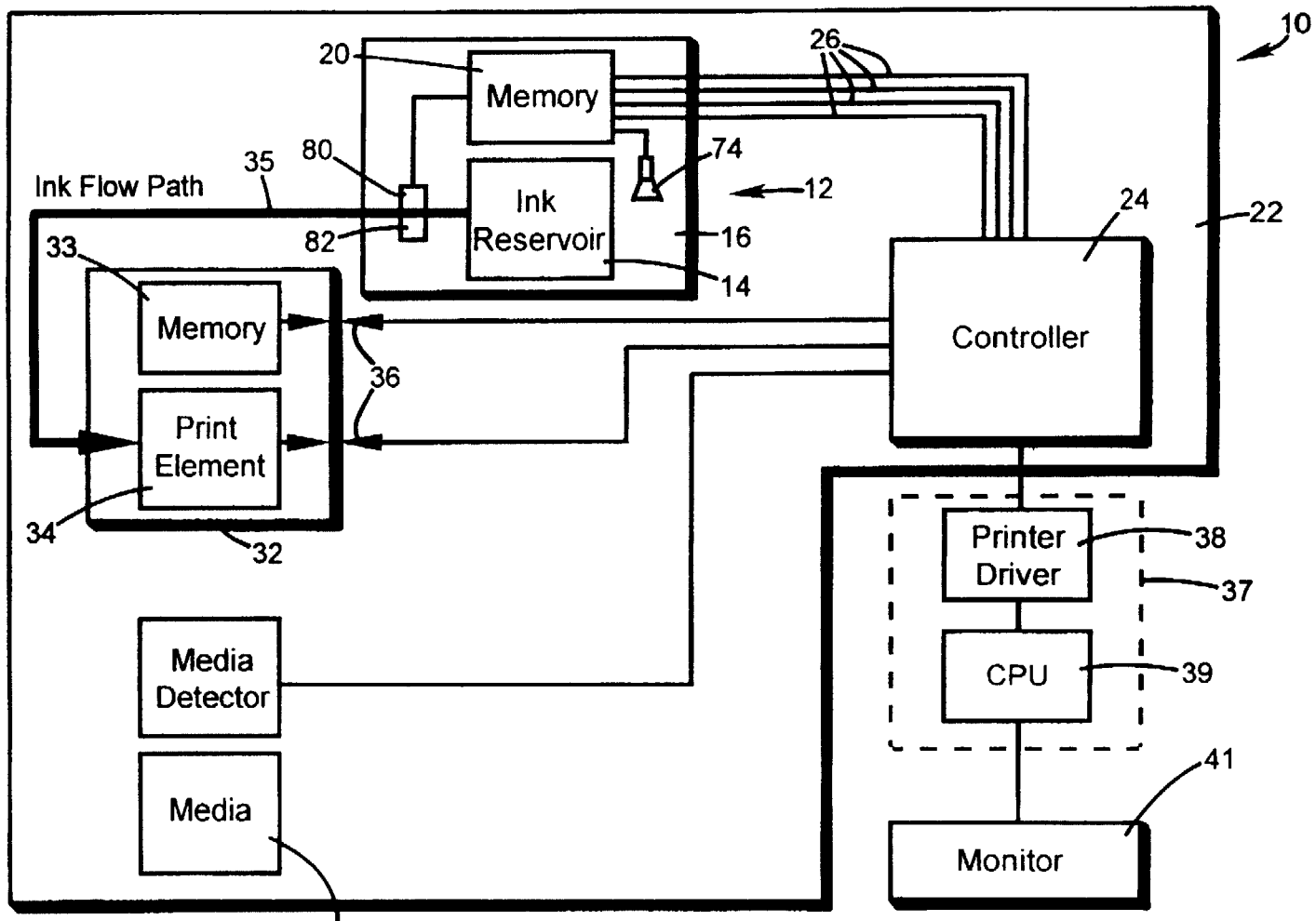
FIG. 2 is a simplified block diagram of the embodiment of FIG. 1.

FIGS. 1 and 2 shows an ink jet printing system or printer 10 having a set of removable ink cartridges 12 for printing onto a sheet of media 13. Each ink cartridge includes an ink reservoir 14 defining a chamber filled with ink, and includes an electronic circuit in a cartridge memory chip 20. The printer has a housing 22 enclosing a controller 24 connected to the cartridge chip 20 via four electrical lines 26. An ink level display 30 is mounted to the housing and electrically connected to the controller as shown, or may be displayed on the user's video display terminal by computer software. A print head 32 having a memory 33 and a print element 34 reciprocates within the housing adjacent to the sheet of media. An ink tube 35 connects the ink supply to the print head, providing ink for printing. A print head control bus 36 electrically connects the controller to the print head, and transmits printing data to the print head. While the schematic is shown as having a single print head and a single ink cartridge for simplicity, the preferred embodiment has four of each element, each corresponding to a particular ink color (black, cyan, yellow, and magenta.) A computer 37 connected to the printer 10 includes a printer driver 38 connected to the controller 24, a central processing unit 39, and a connected monitor 41.

Figure 3:
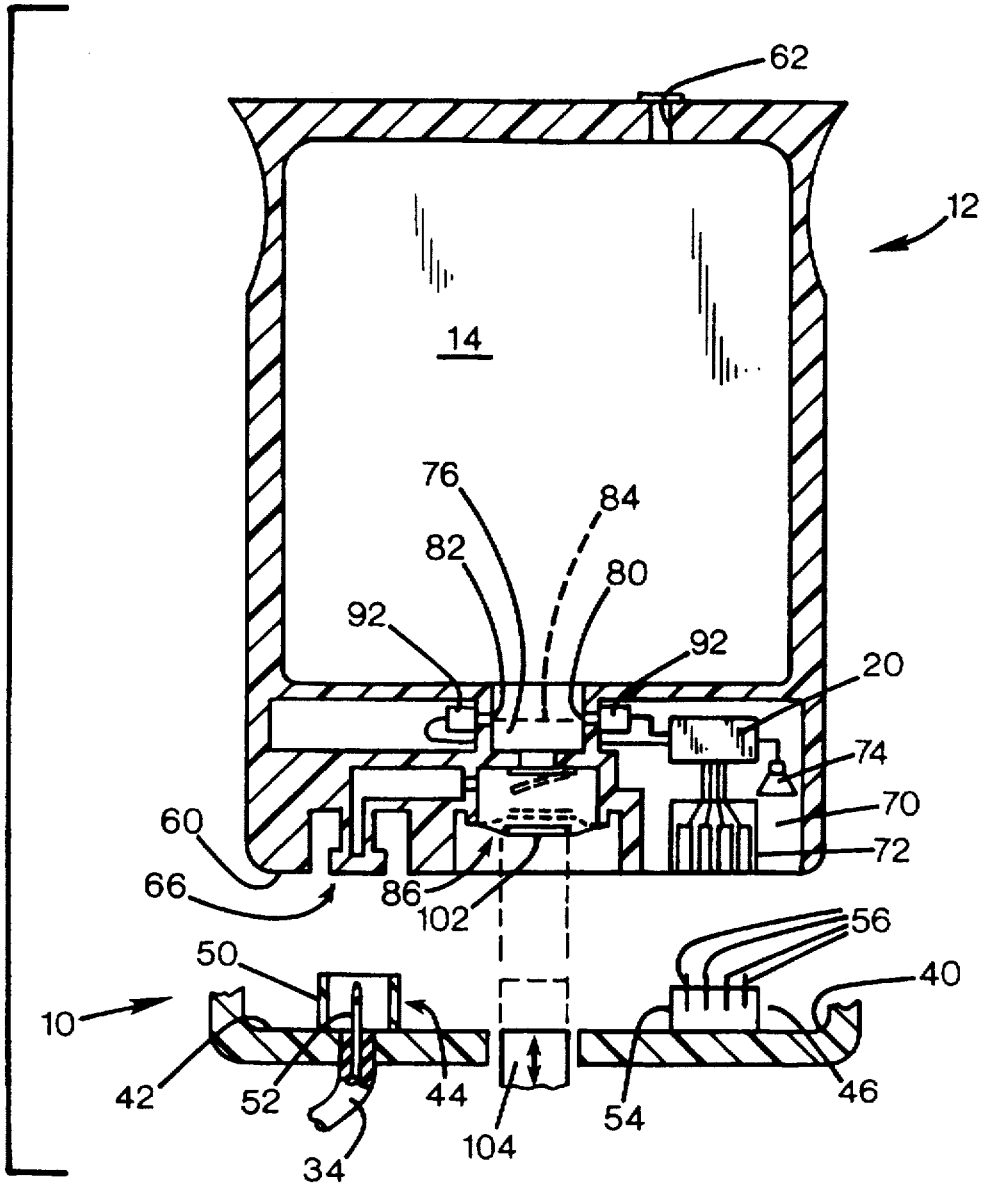
FIG. 3 is an exploded sectional side view of the embodiment of FIG. 1.

FIG. 3 illustrates the ink cartridge 12 in greater detail, with its connection to the printer 10. The printer defines an ink supply station cavity 40 that is fixed relative to the printer housing, and which provides a receptacle to entirely receive the ink cartridge. The station cavity has a floor 42 upon which are mounted a fluid interconnect 44 and an electrical interconnect 46. The fluid interconnect includes an alignment sleeve 50 surrounding a hollow needle 52, with the needle defining a passage connecting to the ink tube 34. Although not shown in detail, the needle is provided with an enclosure to maintain humidity when an ink cartridge is not installed.

The electrical interconnect includes a protruding boss 54 having four pins 56 formed to present laterally extending bent portions. The fluid and electrical interconnects are spaced apart from each other to prevent unexpected ink leakage from encountering the electrical elements.

The ink cartridge 12 is a rigid rectangular shell having a flat, planar aspect parallel to the plane of the figure. The chassis has a leading edge 60 extending toward the floor 42 of the cavity. A sealed ink refill port 62 at the trailing edge of the cartridge provides an aperture for refilling the reservoir 14 after the ink supply is depleted. An ink outlet 66 is positioned at one end of the leading edge in registration with the fluid interconnect 44, and a pocket 70 is defined in the leading edge of the chassis at a position spaced apart from the ink outlet 66. The ink outlet 66 has an end face enclosed by a self-sealing septum that may be penetrated by the needle. The exterior of the outlet is shaped to be closely received within and supported by the collar 50 to provide registration during installation of the cartridge in the printer.

A connector 72 having four separate, conductive planar conductor pads is mounted to one wall of the pocket, so that is parallel to the plane of the ink cartridge. This permits the printer's interconnect pins to scrape along the respective pads as the cartridge is inserted into the ink supply station cavity 40, removing any oxidation or contamination from the pads to ensure proper ohmic contact. The controller chip 20 is mounted within the cartridge pocket, and includes separate connections to each of the four connector pads. An audible alarm 74 such as a piezoelectric device is mounted in the pocket and connected to the controller.

The cartridge is normally oriented in the position illustrated, so that the leading edge is pointed downward. Thus, ink in the chamber 14 will settle toward the bottom. The chamber defines a well 76 that serves as a sump. The well is the last portion of the chamber to empty as the ink supply is depleted; when the well is partially empty, the entire remainder of the cartridge is known to be empty and replenishment is due. In the preferred embodiment, the well is defined by a cylindrical wall having two transparent ports 80, 82 on opposite sides, and positioned at a threshold level 84 spaced a small distance above the bottom of the well. When ink is above the threshold level, the ports are obscured, and when ink falls below the threshold level, the coaxially aligned ports are in visual communication with each other. Because the well has a small cross section in a horizontal plane relative to the rest of the ink chamber, a given rate of ink depletion will cause a rapidly falling ink level, and the volume below the threshold level is relatively small.

An optical ink level sensor has an emitter 90 and a detector 92 positioned within the pocket 70 and electrically connected to the chip 20, with each element at a corresponding port of the well. In the preferred embodiment, the emitter is an infrared LED, and the detector is responsive to the wavelength of light emitted by the LED. The wavelength is selected to transmit effectively through the ports and air, and to be effectively obscured by ink of any color. When the ink level drops below the selected level, the sensor sends an electrical signal to the chip 20, which responds by generating an "ink depleted" signal.

In alternative embodiments using inks transmissive to certain wavelengths, different wavelength LEDs may be selected for different ink colors. For instance, a red LED may be used for all colors but magenta, which employs a green or yellow LED. Alternative ink level sensors may include an optical sensor having an emitter and detector at a single port and operable to detect the presence of ink at the port by sensing the presence or absence of reflected light or other radiation from within the well. Another alternative may electrically detect the presence of ink at the threshold level, such as by positioning electrical leads on opposite sides of the well and determining the electrical resistance or capacitance between the leads.

The threshold volume of the well below the threshold level may be selected to correspond to the amount of ink used in a typical densely printed page, so that the cartridge does not become depleted during the printing of a page. This would require discarding of the page, or interrupting the printing process, which may cause nonuniformity of output due to disruption of the carefully engineered sequence of overlapping printing and drying times. The usable ink remaining in the pump may also be included in the calculation of ink available to complete a page after depletion is detected.

The ink cartridge includes a diaphragm pump 86 to pump ink from the reservoir to the printer. A pump chamber is positioned below the well, with an ink inlet having a check valve providing one way fluid flow from the well to the chamber when the pump chamber is at lower pressure than the well. A pump outlet with provides communication to an outlet conduit extending to the ink outlet 66 of the cartridge.

The pump 86 includes a flexible diaphragm 102 that seals the lower portion of the pump chamber to provide a variable chamber volume. A vertically reciprocating pump pusher 104 mounted on the printer and electrically controlled by the printer controller is registered with the diaphragm. As the pusher presses into the diaphragm, the chamber volume is reduced, driving ink through the chamber outlet to be expelled from the ink outlet 66. Upon withdrawal of the pusher, the diaphragm returns to its original position, aided by a compressed spring (not shown) in the chamber. This draws ink into the chamber through the inlet valve; a pressure regulator associated with the print head functions as a check valve to prevent ink from being drawn back into the pump from downstream.

The printer controller 24 is programmed to keep track of printing activities to maintain an estimate of how much ink has been consumed from each cartridge. Essentially, this may be thought of as a drop counter. Normally, the memory chip on the cartridge chassis serves as the storage site for the drop usage information. The memory of the chip may begin with an "ink full" condition value, which is decremented as printing proceeds, until an "ink empty" state is reached, whereupon the printer will not function until the cartridge is replaced with one indicating "ink full" or an intermediate condition.

By storing this information on each cartridge, cartridges may be removed and replaced without losing usage information. As printing proceeds, the printer reads the usage information stored on the cartridge memory, and displays a corresponding output on the display 30, which may be in the form of a bar graph or "gas gauge." Unlike a fuel gauge in an automobile, such a gauge does not need to sense the current fluid level in the reservoir, so it does not rely on the ink level sensor.

In the preferred embodiment, the memory chip is an EEPROM that may be written to or decremented as ink usage proceeds. Upon complete depletion, the chip may be reset, enabling printing to proceed with a replenished cartridge. In the preferred embodiment, the chip and connector have four lines: power, ground, clock, and input/output. The chip may be an MROM that is never written to, or may include a combination of MROM, EPROM, and EEPROM portions, to emulate the performance of a standard chip. In one embodiment, the drop counter may have an 8-bit write-once memory location, with each bit corresponding to one-eighth of the ink supply, and written to after a fine counter tallies a usage of a quantity of ink droplets equivalent to one-eighth the cartridge capacity.

Each cartridge memory chip may include factory-recorded information such as cartridge volume, day of manufacture, year of manufacture, freshness/expiration date, ink shelf life, and product serial number. The memory may also include ink chemistry and colorimetry data, and information on ink drying time and outgassing rate to enable optimized printing during the life of the cartridge. The chip is also occasionally written to by the printer in conjunction with usage. Such information may include a coarse usage indication in eighths of the total volume, a fine drop count, first usage date, most recent usage date, and duration of time in use.

In an alternative embodiment, the printer's pump pusher 104 applies force by a spring, so that its excursion is limited if it meets substantial resistance from the diaphragm or other impediment. A position sensor on the printer may determine whether the pusher is extending to normal excursions, or if the excursion is excessive or inadequate. If the pump is depleted, for instance, and is unable to draw more ink from the reservoir, the back pressure from the reservoir may create a suction that prevents the diaphragm from returning to its extended position. When this occurs, the pusher extends beyond its normal excursion, and the printer discontinues printing to avoid dry firing.

Figure 4:
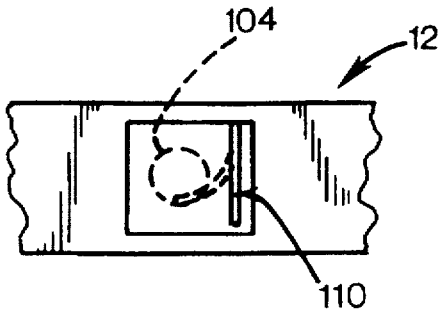
FIG. 4 is a bottom view of the embodiment of FIG. 1.

When the printer has a such a pusher sensor, an alternative means of signaling that ink is depleted may be provided to eliminate the pump entirely from the cartridge. As shown in FIG. 4, to provide the pusher with the expected resistance, a pusher impediment element 110 is mounted to the cartridge in the recess where the diaphragm would be found if a pump were present. The impediment normally extends across the recess at a level corresponding to the normal position of a pump diaphragm. Consequently, the pusher meets with the expected resistance comparable to a full cartridge and normally operating pump, and printing is permitted to continue. When the cartridge sensor 80, 82 detects depletion of ink, it signals the printer to stop by activating the impediment 110 to withdraw it from the path of the pusher. Thus, the pusher extends beyond its normal excursion, and printing is discontinued. In this embodiment, the impediment is a thermally actuated bimetallic strip operated by an electrical signal from the cartridge chip. The strip is normally positioned near the center of the diaphragm and is retracted upon ink depletion as it is heated by current flowing through an associated resistor (not shown) as controlled by the cartridge chip.

Method of Operation

Before printing, the printer is turned on, and the driver and firmware of the printer read the ink level or drop volume from each cartridge memory chip. If a cartridge is absent, the printer will not print, and the user may be notified of the need to install a cartridge. Each time a different cartridge is installed, the contents of the cartridge memory are read into a memory associated with the printer controller.

Operation begins with installation of the cartridge. The user then initiates a new print job, causing the printer to query the cartridge memory chip to determine the amount of ink in the reservoir. The controller calculates an ink level based on the received data, and sends a signal to the display to indicate the ink level to the user. The cartridge chip assesses whether the ink supply is empty by reading the signal from the ink level sensor, and sends the information to the printer to permit or inhibit printing.

If the ink supply is not determined to be empty, the printer prints a portion of the printing job, and updates the memory chip to reflect the ink usage during that printing step. This may include writing to a fine counter on the cartridge memory, and if the fine counter becomes full, writing to one of the coarse counter bits and resetting the fine counter to zero for subsequent printing. The printer then determines whether the print job is complete. If so, the printer stops and awaits instructions to begin a new printing job, whereupon the printer starts the new job. During the print job, at the end of printing each sheet in the job, the controller will read all memory elements to update the displays reflecting ink supplies, and will continually monitor whether the ink level has dropped below the threshold. This will permit user monitoring of ink consumption during large print jobs.

If it is determined that the ink supply is empty, the printer continues for a limited time, such as to finish the page, then halts the print job, and indicates on the display that the ink is empty. To proceed, the user must replace or replenish the ink cartridge. If the cartridge is replenished, the ink usage counter, which reads at or near empty, is reset to indicate that the cartridge is full. Replacement of the cartridge includes installing it in the ink supply station, so that the needle penetrates the septum to provide ink flow, and so that the electrical connector makes contact with each of the four pads on the connector.

After the cartridge is replaced, the printing job is restarted.

An alternative printing operation may be used when the ink cartridge has a simpler ROM chip instead of the EEPROM. The chip is programmed to constantly provide an "ink full" signal to the printer, preventing the printer from shutting down due to drop counting, and disabling the "gas gauge" function. With such an ink cartridge chip, the printer will continue until the ink level sensor indicates depletion, protecting the printer against dry firing. Thus, when the printer checks the chip for ink supply level, it reads the "all full" signal, and proceeds to print the entire job, or portions of the job after occasionally rechecking the ink level. When the level sensor detects depletion, it may either signal the printer directly, actuate an audible alarm on the cartridge or in the printer, or actuate the impediment of FIG. 4 to signal the force sensing pusher, which may also be employed in a drop counting system.

In another alternative embodiment, a kit may be provided that includes a single cartridge and a refill bottle for refilling the reservoir. In this embodiment, the operation may proceed as above, or may use a chip programmed to indicate an initial ink volume equal to the combined volume of cartridge and the entire refill bottle contents. The refill bottle may have a volume larger than the cartridge by an integer multiple n, to provide a limited number of refills. The chip in such a cartridge may permit resetting of the drop counter function only a limited number of times n corresponding to the refill volume ratio. This limits refilling beyond the useful life of the cartridge.

While the invention is described in terms of preferred and alternative embodiment, the following claims are not intended to be so limited.

We claim:

1. A replaceable ink cartridge for an ink jet printing system having an ink supply station with an ink receptacle and a printer electrical connector, the cartridge comprising:

a housing removably matable with the ink supply station, a digital electronic circuit and a connected cartridge electrical connector on the housing, the cartridge electrical connector matable with the printer electrical connector;

an ink reservoir in the housing defining a chamber containing a supply of ink of a selected volume;

the reservoir having an ink outlet connectable to the printer ink receptacle; and an ink level sensor in the housing connected to the digital electronic circuit, and operable to detect whether the supply of ink is less than a threshold amount, and to generate an "ink depleted" signal in response to detecting that the supply of ink contains less than the threshold amount.

2. The ink cartridge of claim 1 wherein the circuit is operable to send the "ink depleted" signal to the printer, such that printer operation is stopped before ink is depleted.

3. The ink cartridge of claim 1 wherein the cartridge includes a movable impediment movable into and out of a position in conflict with a path of motion of a pump actuator on the printer.

4. The ink cartridge of claim 3 wherein the movable element is a bimetallic strip that flexes in response to an electrical signal from the circuit.

5. The ink cartridge of claim 1 wherein the cartridge circuit includes a memory element to which data may be written corresponding to the amount of ink consumed from the reservoir.

6. The ink cartridge of claim 5 wherein the memory element is resettable to an "ink full" condition upon replenishment of the reservoir.

7. The ink jet cartridge of claim 1 including a separate refill bottle having a refill volume greater than the selected volume of the supply of ink in the ink reservoir chamber.

8. The ink cartridge of claim 7 wherein the refill volume is approximately an integer multiple of the selected volume.

9. The ink cartridge of claim 1 wherein the digital electronic circuit includes a digital memory.

10. The ink cartridge of claim 1 wherein the electrical connector includes a plurality of electrical lines.

11. A method of servicing an ink jet cartridge having a supply of ink and removable from a printer operable in response to an ink level signal from the cartridge, the method comprising:

operating the printer to draw ink from the cartridge;

while operating the printer, generating an enabling signal to permit operation of the printer;

while operating the printer, monitoring to determine whether the cartridge contains a selected level of ink;

after determining that the cartridge contains less than a selected level of ink, transmitting a signal to a memory chip on the cartridge and thereafter transmitting a digital "ink depleted" signal from the memory chip to the printer; and stopping operation of the printer in response to the ink depleted signal.

12. The method of claim 11 wherein generating the enabling signal comprises continually generating an "ink full" signal.

13. The method of claim 11 wherein monitoring includes optically detecting the presence of ink.

14. The method of claim 13 wherein optically detecting includes transmitting a beam into the cartridge.

15. The method of claim 11 wherein generating the ink depleted signal includes emitting an audible tone.

16. The method of claim 11 wherein the printer includes an ink pumping actuator operable to contact the ink cartridge to pump ink, and wherein generating the ink depleted signal includes positioning a movable impediment out of conflict with the actuator.

17. The method of claim 11 wherein stopping operation of the printer comprises automatically sending an electronic signal to the printer.

18. The method of claim 11 wherein stopping operation of the printer comprises a user responding to a signal from the cartridge and manually stopping the printer.

19. The method of claim 11 including replenishing the cartridge with ink after stopping operation of the printer.

20. The method of claim 19 wherein replenishing includes resetting an ink level indicator on the cartridge.

21. A printing system comprising:

an ink jet printer defining an ink supply station with an ink receptacle and a printer electrical connector;

an ink cartridge removably connected to the printer, the cartridge comprising:

a housing removably matable with the ink supply station, an electrical digital memory circuit and a connected cartridge electrical connector on the housing, the cartridge connector matable with the printer electrical connector;

an ink reservoir in the housing defining a chamber containing a supply of ink of a selected volume;

the reservoir having an ink outlet connectable to the printer ink receptacle;

an ink level sensor in the housing, connected to the digital memory circuit, and operable to detect whether the supply of ink is less than a threshold amount, and to generate an "ink depleted" signal in response to detecting that the supply of ink contains less than the threshold amount.

22. The system of claim 21 wherein the ink level sensor includes an optical sensor in communication with the reservoir.

23. The system of claim 21 wherein the ink level sensor includes an audible transducer to alert a user to a depleted ink level.

24. The system of claim 21 wherein the circuit is operable to send the "ink depleted" signal to the printer, such that printer operation is stopped before ink is depleted.

25. The ink cartridge of claim 21 wherein the cartridge includes a movable impediment movable into and out of a position in conflict with a path of motion of a pump actuator on the printer.

26. The ink cartridge of claim 21 wherein the cartridge electrical connector includes a plurality of electrical lines.

* * * * *